US006511004B2

(12) United States Patent
Landschoot et al.

(10) Patent No.: US 6,511,004 B2
(45) Date of Patent: Jan. 28, 2003

(54) FUEL INJECTOR COVER

(75) Inventors: Timothy P. Landschoot, Henrietta, NY (US); Karl Jacob Haltiner, Jr., Fairport, NY (US); Robert B. Perry, Leicester, NY (US)

(73) Assignee: Delphi Technologies, Inc., Troy, MI (US)

( * ) Notice: Subject to any disclaimer, the term of this patent is extended or adjusted under 35 U.S.C. 154(b) by 35 days.

(21) Appl. No.: 09/861,977

(22) Filed: Jan. 19, 2001

(65) Prior Publication Data

US 2001/0045473 A1 Nov. 29, 2001

Related U.S. Application Data

(60) Provisional application No. 60/176,978, filed on Jan. 19, 2000.

(51) Int. Cl.[7] ..... B05B 1/30

(52) U.S. Cl. ..... 239/585.1; 239/585.2; 251/129.01

(58) Field of Search ..... 239/585.1–585.5, 239/533.2–533.12, 88–92; 123/467, 470, 468; 251/367, 129.01; 285/26, 65–79

(56) References Cited

U.S. PATENT DOCUMENTS

| | | | | | |
|---|---|---|---|---|---|
| 5,381,965 | A | * | 1/1995 | Chabon et al. | 239/585.1 |
| 5,465,911 | A | * | 11/1995 | Hall | 239/585.1 |
| 5,692,723 | A | * | 12/1997 | Baxter et al. | 239/585.1 |
| 5,820,099 | A | * | 10/1998 | Rahbar et al. | 251/129.21 |
| 5,823,445 | A | * | 10/1998 | Sofer | 239/585.1 |
| 6,019,297 | A | * | 2/2000 | Hall | 239/585.1 |

* cited by examiner

*Primary Examiner*—Michael Mar
*Assistant Examiner*—Dinh Q. Nguyen
(74) *Attorney, Agent, or Firm*—Patrick M. Griffin

(57) ABSTRACT

A cover for use with a fuel injector. The cover formed of at least two separate pieces that are assemble over the fuel injector. The pieces are held together by a detent member and cooperate to form a cavity that houses the fuel injector. A complaint member is positioned within the cavity to minimize relative movement between the cover and the fuel injector.

18 Claims, 4 Drawing Sheets

FUEL INJECTOR COVER

This application claims the benefit of Provisional Application No. 60/176,978, filed Oct. 19, 2000.

TECHNICAL FIELD

The present invention relates generally to engine fuel injectors and, more particularly, to a cover that fits over the fuel injector.

BACKGROUND OF THE INVENTION

Is known in the art to provide a fuel injector to inject fuel into an engine. It is further known to provide a cover for the fuel injector wherein the cover is overmolded on the fuel injector. During the overmolding process, the fuel injector is placed in a mold after which the cover material, typically a thermoplastic, is injected into the mold to overmold the cover on the fuel injector.

Since the cover is formed by overmolding, the possibility exists that the overmolding process can damage the part if the fuel injector is not properly placed in the overmolding machine. Further, overmolding may result in flash or excess molded material that may further damage the fuel injector. In both cases the entire assembly, fuel injector and cover, are considered scrap and must be discarded. In addition the overmolding process requires a longer cycle time, as opposed to injection, which correspondingly increases the cost of the overmolding process. Accordingly, the overall cost of manufacture increases as a result of having to discard or scrap the entire injector with an improperly overmolded cover.

Therefore, it is desirable to provide a cover for a fuel injector and cover assembly that is simpler to manufacture, requires less expensive components than the overmolding process, eliminates molding concerns including flash problems and is easier to assemble.

SUMMARY OF THE INVENTION

The present invention provides a cover for use with a fuel injector wherein the cover comprises first and second members. The first and second members each having a pocket therein. The pockets on the first and second members cooperating together to form a cavity when the first and second members are joined together. The fuel injector is sandwiched between the respective first and second members and captured in the cavity such that the cover surrounds at least a portion of the fuel injector.

A detent member positioned on at least one of the first or second members releasably engages a engagement portion located on the opposite member to connect the first and second members together.

The present invention provides a cover for a fuel injector that may be molded in two individual portions separate from the fuel injector in an injection molding process which correspondingly reduces the cost. Further, the present invention reduces scrap cost due to elimination of the overmolding process that, when not performed properly, requires the entire fuel injector and overmolded cover assembly to be scrapped.

Other objects, features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
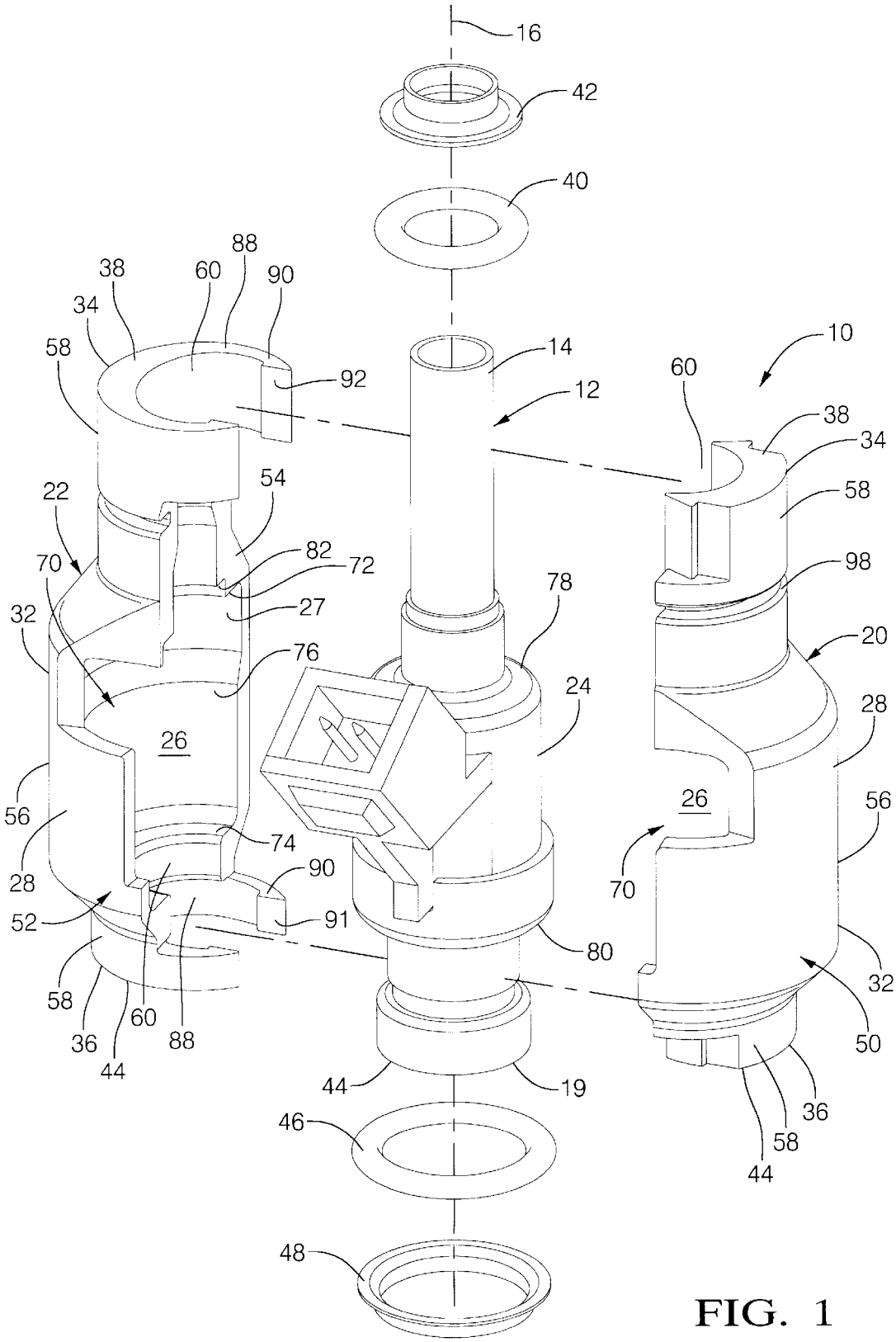
FIG. 1 is an exploded, perspective view of a cover according to the present invention shown in connection with a fuel injector.

Referring first to FIG. 1 of the drawings there is shown a cover, seen generally at 10, for use with a fuel injector, seen generally at 12. The fuel injector 12 includes a fuel tube 14 disposed about a longitudinal axis 16. The fuel injector 10 provides a continuous fuel passage through the injector from an inlet end 18 of the fuel tube 14 to a discharge end 19 of the fuel injector 12. Preferably, the fuel tube 14 and fuel injector 12 have no openings except at the inlet 18 and discharge 19 ends and defines a continuous and preferred passage in which fuel is conducted separate from all of the components of the fuel injector 12 that are mounted externally of the fuel tube 14 and fuel injector 12.

The cover 10 is formed or molded in two pieces, specifically a first member 20 and a second member 22. The first member 20 and second member 22 are then assembled over the fuel injector 12 and surround the body 24 of the fuel injector 12. Each of the first and second 22 members includes a pocket 26 formed in an inner surface 27 the body 28 of each member 20, 22. The pockets 26 cooperating together such that when the first 20 and second 22 members are placed adjacent they form a cavity 30 that surrounds the body 24 of the fuel injector 12.

The first 20 and second 22 members each having an outer surface 32 along with a first longitudinal end 34 and a second longitudinal end 36. A support surface 38 located on the first longitudinal end 34 supports a seal ring 40 positioned on the fuel tube 14. A seal retainer 42 is retained on the fuel tube 14 to hold the seal ring 40 in place. Correspondingly, a support surface 44 is located on the second longitudinal end 36 and supports an additional seal ring 46 placed on the discharge end 19 of the fuel injector 12. An additional seal retainer 48 is used to hold the seal ring 46 on the discharge longitudinal end 20 of the fuel injector 12.

Figure 2:
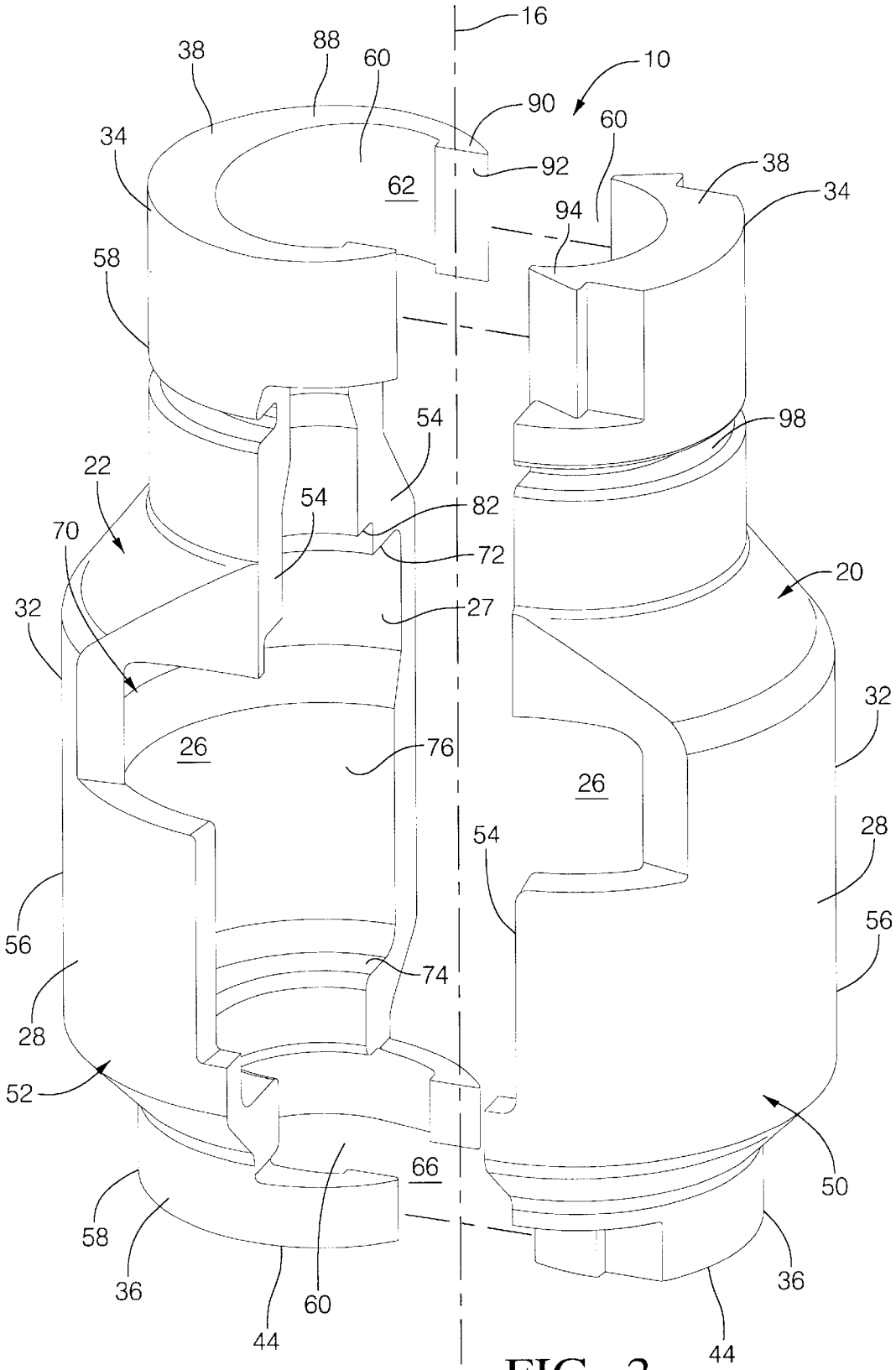
FIG. 2 is an exploded, perspective view of a cover according to the present invention.

In the preferred embodiment, the cover 10 as shown, see FIGS. 1 and 2, is a substantially tubular member, having a generally cylindrical shape. As shown in the drawings, the cover 10 or substantially tubular member is formed by semi-tubular members 50, 52 that are joined together at respective mating surfaces 54. Thus, according to the preferred embodiment, the first member 20 is formed by the semi-tubular member 50 and the second member 22 is formed by the opposite semi-tubular member 52. The semi-tubular members 50, 52 further include a barrel shaped body 56 having elongated neck portions 58 extending longitudinally from each end of the barrel shaped body 56. The elongated neck portions 58, including a channel 60 that, when cooperating with the neck portion 58 on the opposite semi tubular members 52, forms a passageway 62 through which the fuel tube 14 extends. Correspondingly the elongated neck portion 58 corresponding to the second longitudinal end 36 includes a channel 60 that, when cooperating with a channel 60 on the opposite semi-tubular member 52 forms a passageway 66 through which the discharge end 19 of the fuel injector 12 extends.

As shown in FIGS. 1 and 2, the barrel shaped body 56 includes an opening 70 through which a portion of the fuel injector 12 extends. The opening is necessary to enable access to provide power and control signals to the fuel injector 12. Depending upon the particular configuration of a fuel injector 12, the opening 70 may be larger, smaller or in some instances not needed depending upon the particular configuration of the fuel injector 12.

Figure 3:
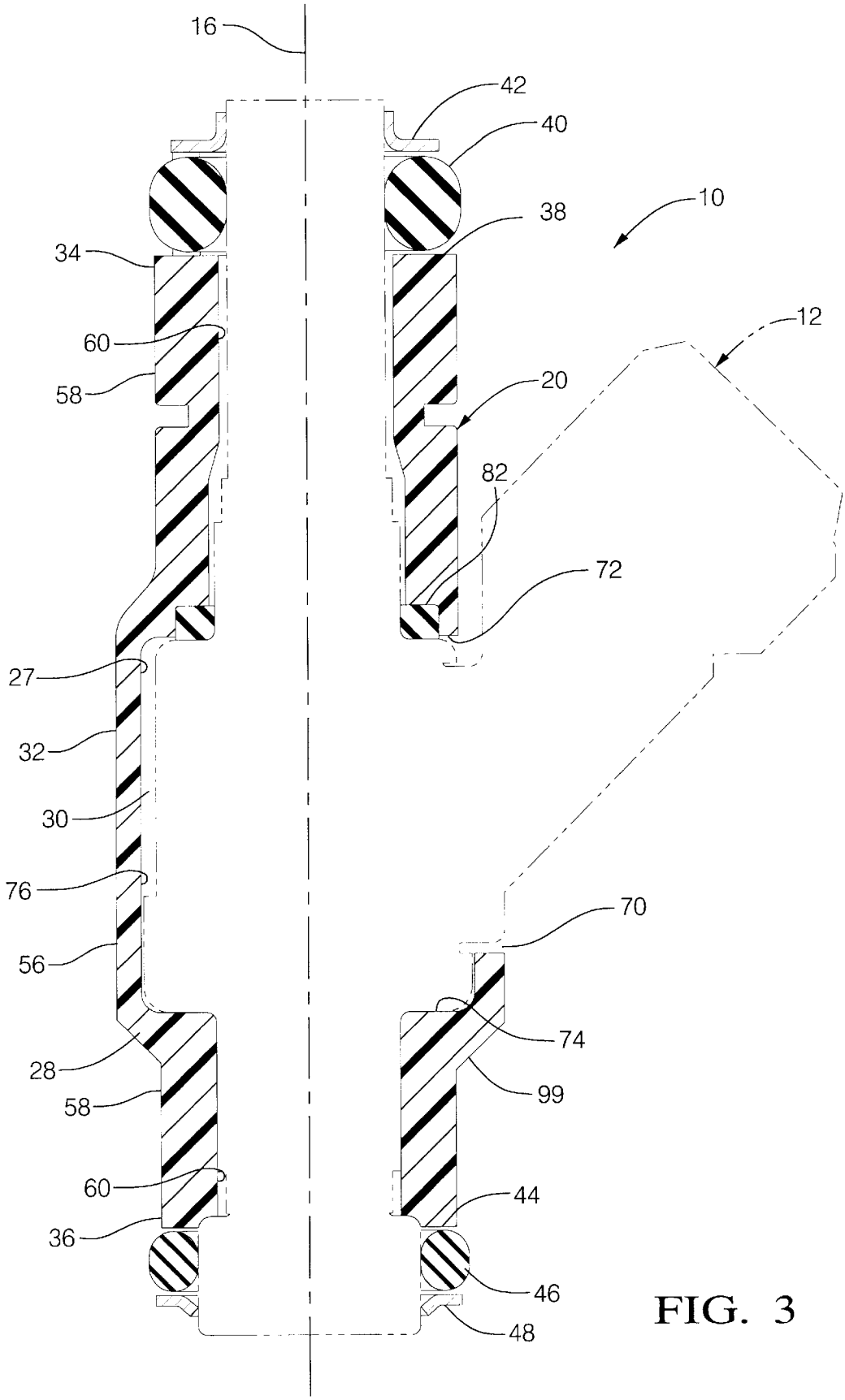
FIG. 3 is a cross-sectional view of a preferred embodiment of the cover according to the invention as shown in FIG. 1.

As shown in the drawings, the pocket 26 located in the semi-tubular member 52 includes upper 72 and lower 74 surfaces interconnected by a wall 76. Turning to FIG. 3, the body 24 of the fuel injector 12 is positioned in the pocket 26 wherein the upper 78 and lower 80 shoulders of the body 24 are constrained by the upper 72 and lower 74 surfaces. The upper surface 72, as shown in FIG. 3, includes a circumferential notch 82 that receives a compliant member 84. The compliant member absorbs clearances during assembly and operates to minimize or eliminate relative motion between the fuel injector 12 and cover 10. As disclosed herein, the compliant member 84 could be a rubber washer or any other type of resilient member that functions as a compliant member. Also, the compliant member 84 includes any type of member that acts to take up clearance or space between the fuel injector 12 and cover 10. For example an epoxy filler or crushable ribs on the upper 72 or lower 74 surface of the cavity 30 may also be used.

The first 20 and second 22 members, or as set forth in the preferred embodiment, the semi-tubular members 52 are held together by a detent member 86. The function of the detent member 86 is to secure the respective first and second members together to form the cover 10. Accordingly, any detent member capable of accomplishing such a function is contemplated as part of the invention. In the preferred embodiment, the detent member 86 includes a pair of opposed resilient arms 88 located at the first 34 and second 36 longitudinal ends of either the first 20 or second 22 member of the cover 10. The resilient arms 88 include a locking projection 90 having a chamfered surface 92. The resilient arms 88 cooperate with an engagement or receiving member 94 located on the first 34 and second 36 longitudinal ends of the opposite member. The engagement or receiving member 94 has a corresponding chamfered surface 96 that cooperates with the chamfered surface 92 on the locking projection 90 to outwardly deflect the resilient arms 88 and allow the arms 88 to snap into engagement with the engagement or receiving member 94. As set forth above, other types of detent mechanisms are known that accomplish the same function of securing the respective first 20 and second 22 members together and are suitable for use with the present invention. In addition other joining methods such as ultrasonic welding, adhesives or heat staking may also be used to couple the respective first 20 and second 22 members together instead of the detent member 86.

The cover 10 also includes a groove 98 that receives a retainer clip, not shown, that holds the fuel tube 14 within a cup of an associated fuel rail, not shown.

Figure 4:
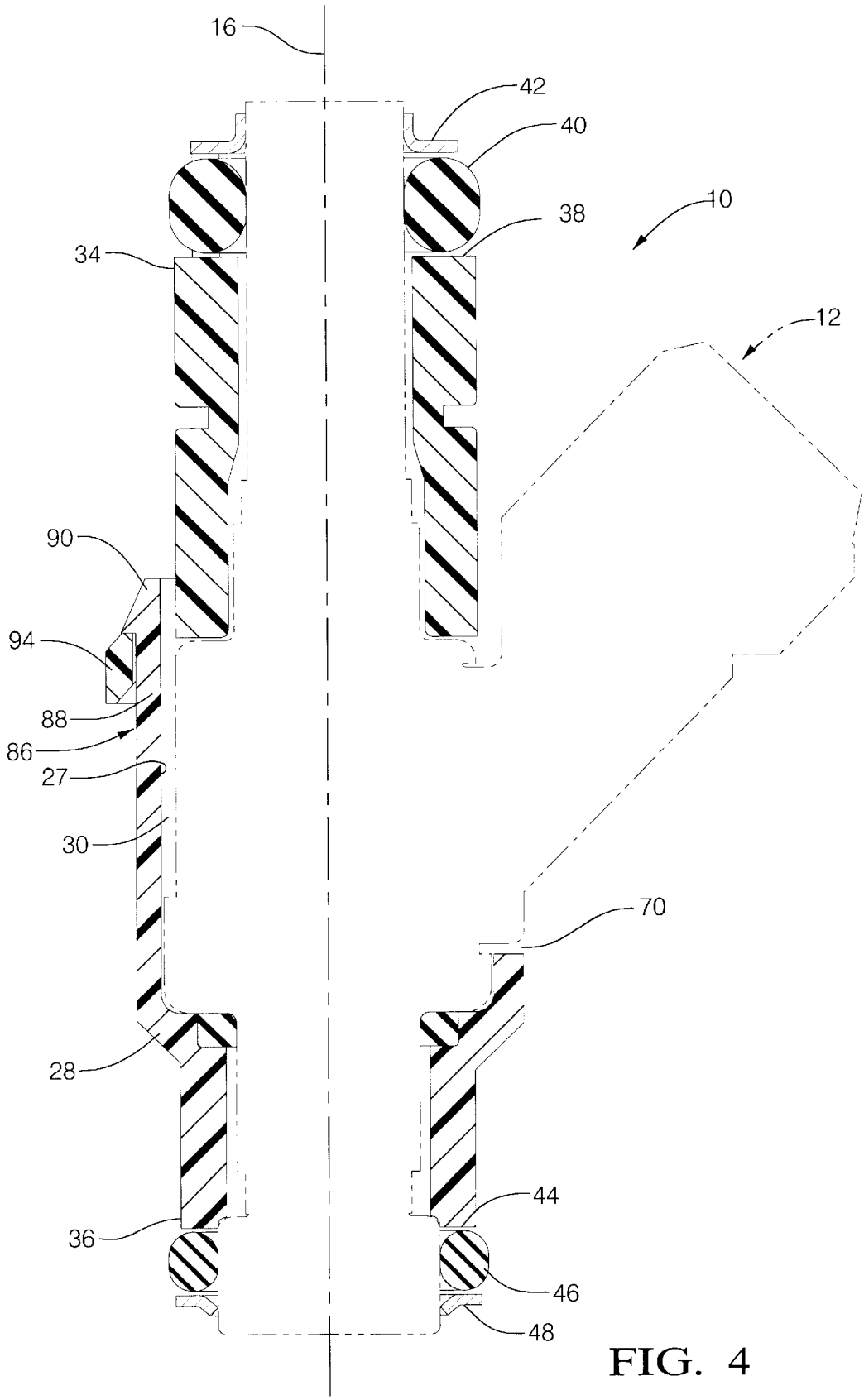
FIG. 4 is a cross-section view of an alternative embodiment of the cover according to the present invention, wherein the members of the cover separate axially along the longitudinal axis of the cover.

Turning now to a FIG. 4, there is shown an alternative embodiment of the present invention wherein the first 20 and second 22 members are parted in an axial direction, along with the longitudinal axis 16 as opposed to a direction transverse the longitudinal axis 16 as shown in the previous embodiment. As shown in FIG. 4, the detent member 86 operates to engage the respective top or first member 20 of the cover 10. Accordingly, the cover 10 of the present embodiment is assembled by the sliding the top or first member 20 over the fuel tube 14 and sliding the corresponding bottom or second member 22 of the cover 10 upward from the discharge end 19 of the fuel injector 12. Again the detent member 86 includes resilient arms 88 having a locking projection 90 that engage an engagement or receiving member 94. Further, the alternative embodiment includes a compliant member 84 positioned in the bottom or second member 22, that as set forth previously, functions during assembly to absorb assembly clearances and minimize relative motion between the cover 10 and fuel injector 12. As with the previous embodiment, the compliant member is situated in a circumferential notch 82 located in the cover 10 and adjacent the cavity 30. In addition, the cover 10 includes a manifold stop surface 99 that prevents the injector from falling into the manifold, not shown, if the rail clip comes off of the fuel rail.

It should be understood that the cover 10 may have any shape, including square, rectangular or any other configuration. Further, the cavity 30 may take any shape desired to adequately house and support the fuel injector 12. The cover 10 is designed to snap fit over the fuel injector 12 and is designed to carry any compressive loads occurring during installation of the fuel injector 12 in the fuel rail and manifold. The cover 10 further provides for backup and support of the respective upper 40 and lower 44 seal rings. The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An apparatus comprising a cover and a fuel injector, said apparatus comprising:

said cover formed by first and second members;

said first and second members each having a pocket therein, said pockets on said first and second members cooperating such that when the respective first and second members are joined together, the respective pockets form a cavity in which the fuel injector is captured such that the cover surrounds at least a portion of the fuel injector; and a detent member positioned on at least one of said first or second members for releasably engaging the other of said first or said second members to connect the first and second members together.

2. The apparatus comprising a cover and a fuel injector as set forth in claim 1 wherein said detent member includes a resilient arm having a locking projection; and an engagement member located on the other of said first or second members to secure the respective first and second members together.

3. The apparatus comprising a cover and a fuel injector as set forth in claim 1 wherein a compliant member is disposed within said cavity, said compliant member engaging the cover and the fuel injector.

4. The apparatus comprising a cover and a fuel injector as set forth in claim 1 wherein the cover has a clip groove extending circumferentially about an outer surface of the cover.

5. The apparatus comprising a cover and a fuel injector as set forth in claim 1, said cover including first and second longitudinal ends, and first and second support surfaces adjacent each of said first and second longitudinal ends.

6. The apparatus comprising a cover and a fuel injector as set forth in claim 1 wherein the cover is a substantially tubular member and said first and second members are semi-tubular members each having an inner surface and an outer surface.

7. The apparatus comprising a cover and a fuel injector as set forth in claim 1 wherein said first and said second members are disposed about a longitudinal axis of the cover wherein said first and second members are separable along the longitudinal axis of the cover in a direction transverse said longitudinal axis.

8. The apparatus comprising a cover and a fuel injector as set forth in claim 6 wherein said semi-tubular members include a barrel shaped body having an elongated neck portion on each end thereof, said elongated neck portions having a channel formed on an inner surface thereof.

9. The apparatus comprising a cover and a fuel injector as set forth in claim 8 wherein said barrel shaped body includes an opening therein, said opening extending from an inner surface to an outer surface of said barrel shaped body such that a portion of said fuel injector extends outward through said opening.

10. The apparatus comprising a cover and a fuel injector as set forth in claim 1 wherein said cavity includes upper and lower surfaces extending radially outward relative to a longitudinal axis of the cover and a wall extending between said upper and lower surfaces.

11. The apparatus comprising a cover and a fuel injector as set forth in claim 1 wherein said cavity includes upper and lower surfaces extending radially outward relative to a longitudinal axis of the cover; and said compliant member is seated on at least one of said upper or lower surfaces and engaging said fuel injector to reduce relative movement between the cover and the fuel injector.

12. An apparatus comprising a cover and a fuel injector, said apparatus comprising:

said cover formed by first and second members;

said first and second members each having a pocket therein, said pockets on said first and second members cooperating such that when the respective first and second members are joined together, the respective pockets combine to form a cavity in which the fuel is captured such that the cover surrounds at least a portion of the fuel injector;

said cavity including upper and lower surfaces extending radially outward relative to a longitudinal axis of the cover and a wall extending between said upper and lower surfaces;

a compliant member, said compliant member seated on at least one of said upper or lower surfaces and engaging said fuel injector to reduce relative movement between the cover and the fuel injector; and said first or second members joined together such that said first and second members connect to form the cavity surrounding the fuel injector.

13. The apparatus comprising a cover and a fuel injector as set forth in claim 12, wherein a detent member includes a resilient finger having a locking projection wherein said locking projection engages an engagement portion located on the other of said first or second members to secure the respective first and second members together.

14. The apparatus comprising a cover and a fuel injector as set forth in claim 12 wherein the cover includes a barrel-shaped body having an elongated neck portion on each thereof, each of said elongated neck portions having a channel formed on an inner surface thereof.

15. The apparatus comprising a cover and a fuel injector as set forth in claim 12 wherein said cover includes an opening therein, said opening extending from an inner surface to an outer surface of said cover such that a portion of said fuel injector extends outward through said opening.

16. The apparatus comprising a cover and a fuel injector as set forth in claim 14 wherein said barrel-shaped body includes an opening therein, said opening extending from an inner surface to an outer surface of said barrel- shaped body such that a portion of said fuel injector extends outward through said opening.

17. An apparatus comprising a cover and a fuel injector, said apparatus comprising:

said cover formed by first and second members disposed about a longitudinal axis of the cover wherein said first and second members are separable along the longitudinal axis of the cover in a direction transverse said longitudinal axis;

said first and second members each having a pocket therein, said pockets on said first and second members cooperating such that when the respective first and second members are joined together, the respective pockets combine to form a cavity in which the fuel injector is captured such that the cover surrounds at least a portion of the fuel injector;

said cavity including upper and lower surfaces extending radially outward relative to a longitudinal axis of the cover and a wall extending between said upper and lower surfaces;

a compliant member, said compliant member seated on at least one of said upper or lower surface and engaging said fuel injector to reduce relative movement between the cover and the fuel injector; and a detent member positioned on at least one of said first or second members for releasably engaging the other of said first or second members to connect the first and second members together, said detent member including at least one resilient arm having a locking projection located thereon.

18. The apparatus comprising a cover and a fuel injector as set forth in claim 17 wherein said cover includes first and second longitudinal ends;

first and second supports surfaces positioned adjacent said first and second longitudinal ends, said first and second supports surfaces providing support for upper and lower rings of the fuel injector.

* * * * *